US008083659B2

(12) United States Patent
Monti

(10) Patent No.: US 8,083,659 B2
(45) Date of Patent: Dec. 27, 2011

(54) APPARATUS FOR ERECTING RIBBED CARDBOARD FOR PROTECTING PACKED PRODUCTS

(75) Inventor: Giuseppe Monti, Pianoro (IT)

(73) Assignee: Marchesini Group S.p.A., Pianoro (Bologna) (IT)

( * ) Notice: Subject to any disclaimer, the term of this patent is extended or adjusted under 35 U.S.C. 154(b) by 257 days.

(21) Appl. No.: 12/417,451

(22) Filed: Apr. 2, 2009

(65) Prior Publication Data

US 2009/0264269 A1 Oct. 22, 2009

(30) Foreign Application Priority Data

Apr. 21, 2008 (IT) ..... BO2008A0250

(51) Int. Cl.
*B31B 1/28* (2006.01)

(52) U.S. Cl. ..... 493/163; 493/52; 493/69; 493/143

(58) Field of Classification Search ..... 493/163, 493/51, 52, 68, 69, 79, 80, 58, 143, 144, 493/145

See application file for complete search history.

(56) References Cited

U.S. PATENT DOCUMENTS

| | | | | | |
|---|---|---|---|---|---|
| 1,976,211 | A | * | 10/1934 | Bickford | 53/412 |
| 1,983,323 | A | * | 12/1934 | Stokes | 493/55 |
| 2,492,886 | A | * | 12/1949 | Punte | 493/61 |
| 3,420,037 | A | * | 1/1969 | Anderson et al. | 53/566 |
| 3,683,755 | A | * | 8/1972 | Lattke | 493/123 |
| 4,066,009 | A | * | 1/1978 | Calvert et al. | 493/316 |
| 4,109,444 | A | * | 8/1978 | Lee | 53/566 |
| 4,232,591 | A | * | 11/1980 | Karpinsky | 493/314 |
| 4,250,693 | A | * | 2/1981 | Andersson | 53/543 |
| 5,027,586 | A | * | 7/1991 | Ramaker | |
| 5,473,868 | A | * | 12/1995 | Antonio | 53/566 |
| 5,971,906 | A | * | 10/1999 | Tharpe et al. | 493/131 |
| 6,641,515 | B2 | * | 11/2003 | Ferri et al. | 493/158 |
| 7,128,520 | B2 | * | 10/2006 | Monti | 414/794.2 |

FOREIGN PATENT DOCUMENTS

| | | | |
|---|---|---|---|
| WO | WO88/09291 | A * | 12/1988 |
| WO | WO2004/076286 | A * | 9/2004 |

OTHER PUBLICATIONS

International Search Report, dated Jun. 12, 2009.

* cited by examiner

*Primary Examiner* — Sameh H. Tawfik

(74) *Attorney, Agent, or Firm* — William J. Sapone; Coleman Sudol Sapone P.C.

(57) ABSTRACT

The apparatus for erecting ribbed cardboard for protecting packed products comprises a collecting device provided with gripping means which are mobile between a gripping station of a single blank sheet of ribbed cardboard from a collecting store and a folding station of the sheet. A folding matrix is destined to receive a single sheet of ribbed cardboard supplied by the collecting device. The forming punch is destined to cooperate with the folding matrix in order to fold opposite lateral flaps of the sheet by contact with the folding means. The forming punch is destined to retain the sheet on completion of the folding stage. A transfer device hingedly bearing the forming punch and destined to move the forming punch between the folding station and a release station of the sheet, which sheet is retained in a folded configuration by the forming punch and a packing line of the products.

8 Claims, 12 Drawing Sheets

FIG. 8A
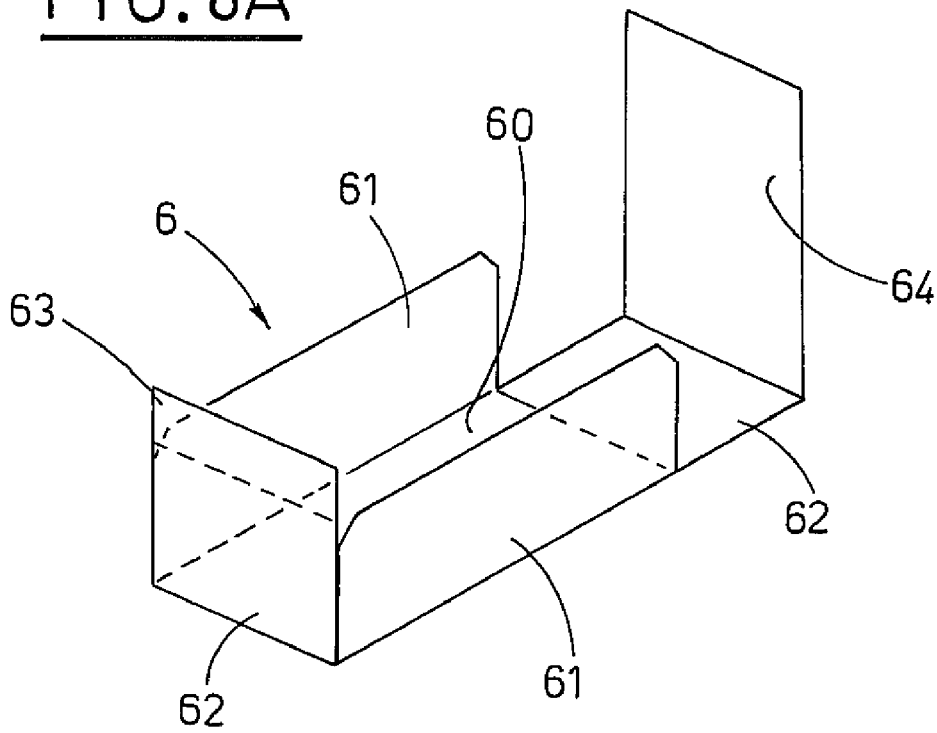
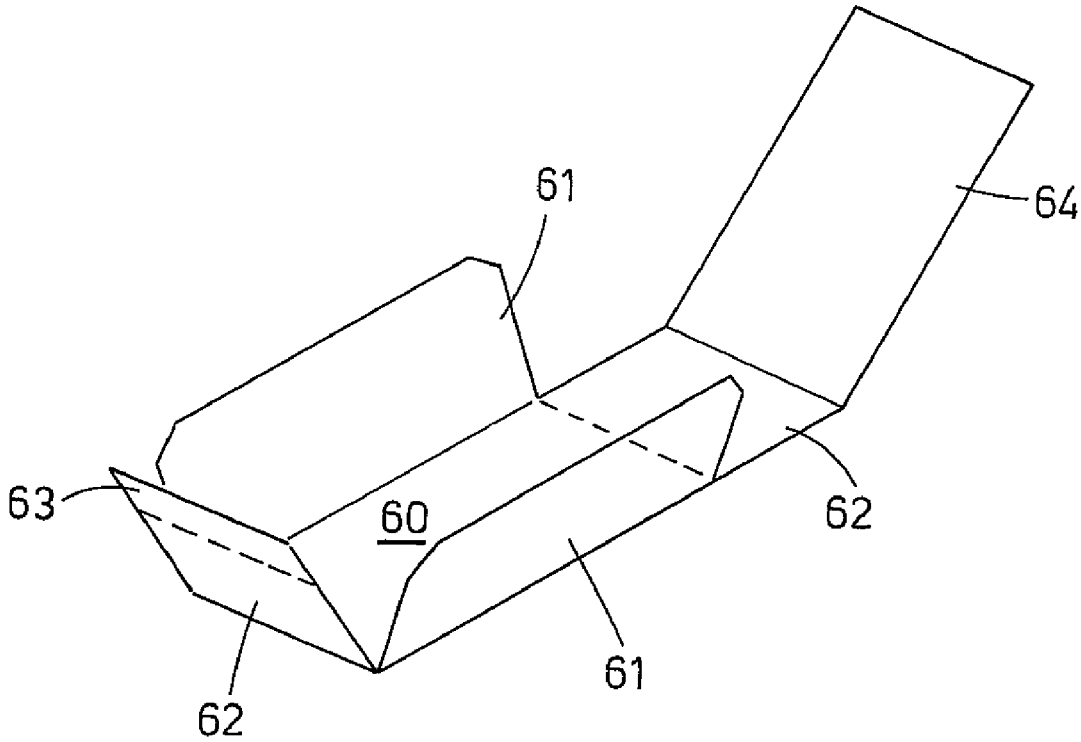
FIG. 9A

FIG. 10A
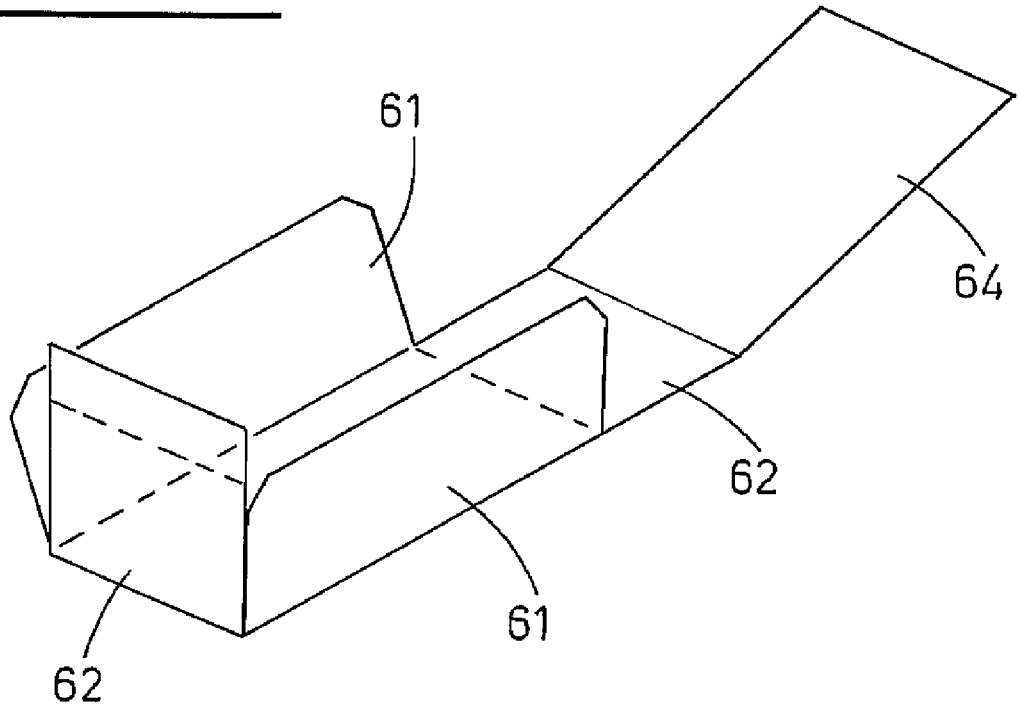
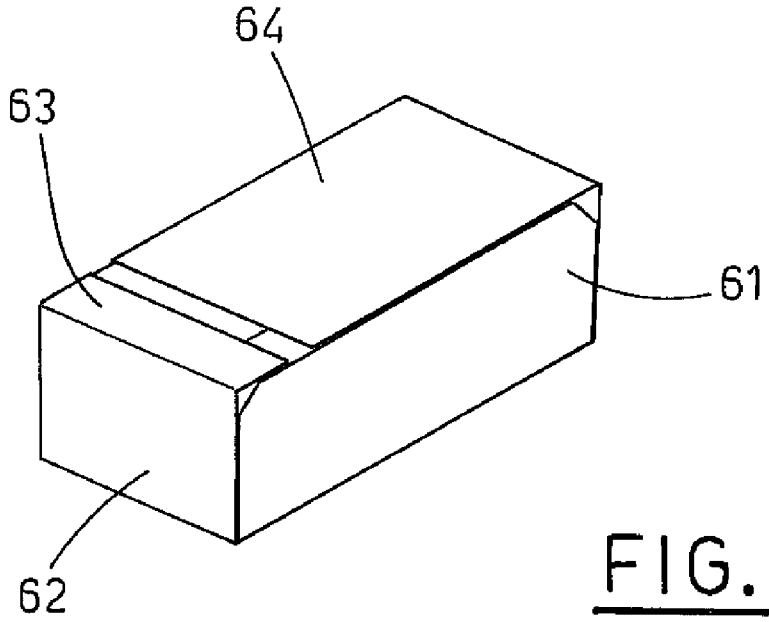
FIG. 11

APPARATUS FOR ERECTING RIBBED CARDBOARD FOR PROTECTING PACKED PRODUCTS

BACKGROUND OF THE INVENTION

The invention relates to an apparatus for predisposing and erecting ribbed cardboard for protecting products, in particular precious articles, in a packing line for the products.

The prior art comprises methods for packing precious products, such as for example perfumes and the like, in which paper-based packing is often used comprising sheets of material of a ribbed cardboard type. The use of this material enables an aesthetically-pleasing pack to be obtained while at the same time providing effective protection for the product, often realized in glass or another fragile material, from impacts and external shocks.

In particular, methods and apparatus are known which efficiently enable packs to be obtained which comprise a box-shaped external pack, internally exhibiting a sheet of shaped ribbed cardboard destined to contain a single product, for example a small glass bottle.

These methods and apparatus of known type essentially comprise predisposing a sheet of ribbed cardboard, specially cut to measure, and folding the sheet into the desired shape with alternated movements on the part of special mobile folding means, inserting a single product internally of the sheet of ribbed cardboard and proceeding to the realizing of the external packing.

The apparatus at present known, however, generally do not enable this type of pack to be realized when operating the erecting and inserting of the ribbed cardboard continuously in the packing line. This often leads to a limitation in the production speed of the line.

SUMMARY OF THE INVENTION

The task of the present invention is to resolve the cited problem, by providing an apparatus which enables efficiently predisposing, erecting and inserting the ribbed cardboard for protecting products in the packing line.

In the ambit of this aim, a further aim of the invention is provide an apparatus able to operate continuously and with a high production speed.

A further aim is to provide an apparatus of simple constructional and functional concept, provided with surely reliable functioning, versatile in use thereof, as well as being relatively economical.

The stated aims are obtained according to an apparatus for erecting ribbed cardboard for protecting packed products, which comprises: a collecting device provided with gripping means which are mobile between a gripping station of a single blank sheet of ribbed cardboard from a store and a folding station of the sheet; a folding matrix, arranged in the folding station, destined to receive a single sheet of ribbed cardboard supplied by the collecting device and provided with a plurality of folding means; a forming punch destined to cooperate with the folding matrix, in the folding station, in order to fold opposite lateral flaps of the sheet by contact with the folding means, the forming punch being destined to retain the sheet on completion of the folding stage; a transfer device hingedly bearing the forming punch and destined to move the forming punch between the folding station and a release station of the sheet, which sheet is retained in a folded configuration by the forming punch in a packing line of the products.

BRIEF DESCRIPTION OF THE DRAWINGS

The characteristics of the invention are explained in the following, with particular reference to the accompanying tables of drawings, in which:

FIGS. 8A, 9A and 10A illustrate an axonometric view of a ribbed cardboard sheet during various erection stages thereof;

FIG. 11 is the same axonometric view of the ribbed cardboard sheet in the final packing configuration of the product.

DESCRIPTION OF THE PREFERRED EMBODIMENT

Figure 1:
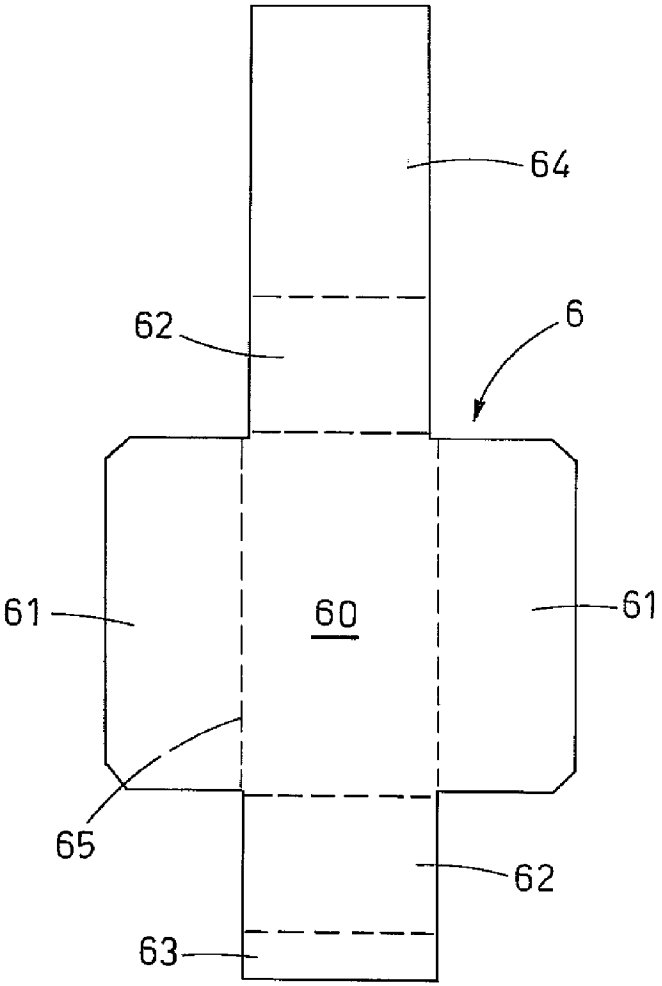
FIG. 1 is a plan view of a blank sheet of ribbed cardboard material, used in the apparatus of the invention.
Figure 2:
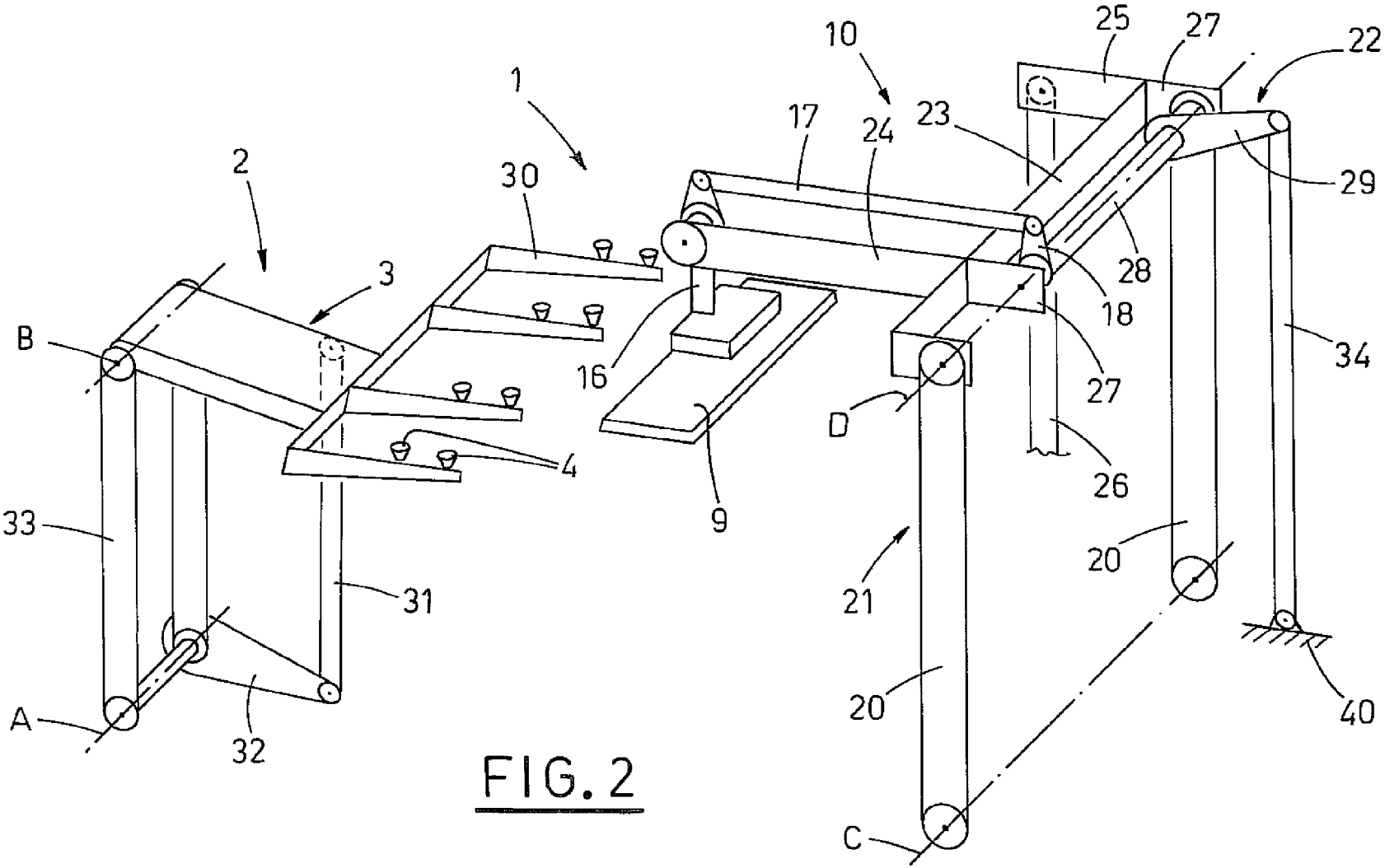
FIG. 2 is a schematic axonometric view of the apparatus of the invention.

With particular reference to the figures of the drawings, 1 denotes in its entirety an apparatus for predisposing and erecting a ribbed cardboard sheet 6 for protecting products, in particular precious articles such as perfumery articles and the like, destined to be packed in a packing line of the products. As illustrated in FIG. 1, the ribbed cardboard sheet 6 is constituted by a blank sheet in which score lines 65 define a rectangular bottom 60 from which opposite lateral flaps 61, 62 extend; a pair of the flaps 62 extend in respective folds 62, 64 destined to realize the closure surface of the ribbed cardboard when erected (see FIG. 11).

The apparatus 1 comprises a collecting device 2 provided with gripping means 4, for example suckers, which are moved between a gripping station S of a single sheet 6 of ribbed cardboard material from a collecting station 5 and a folding station F of the blank sheet 6. More precisely, the collecting device 2 comprises a frame 3 forming a plurality of parallel arms 30 provided at respective ends with the above-mentioned suckers 4; the frame 3 is articulated by means of a tie rod 31 connecting to a command lever which is activatable in angular rotation about a substantially horizontal first axis A. A pair of parallel arms 33 are pivoted on the axis A, independently of the command lever 32, which pair of parallel arms 33 bear the frame 3, hinged to the ends thereof at an axis B which is parallel to the first axis A. In substance, the command lever 32 with the arms 33 and the connecting tie rod 31 form a kinematic assembly which activates the frame 3 bearing the suckers 4 with a rotating-translating motion with respect to axis A, as will be more fully explained herein below.

Figure 7B:
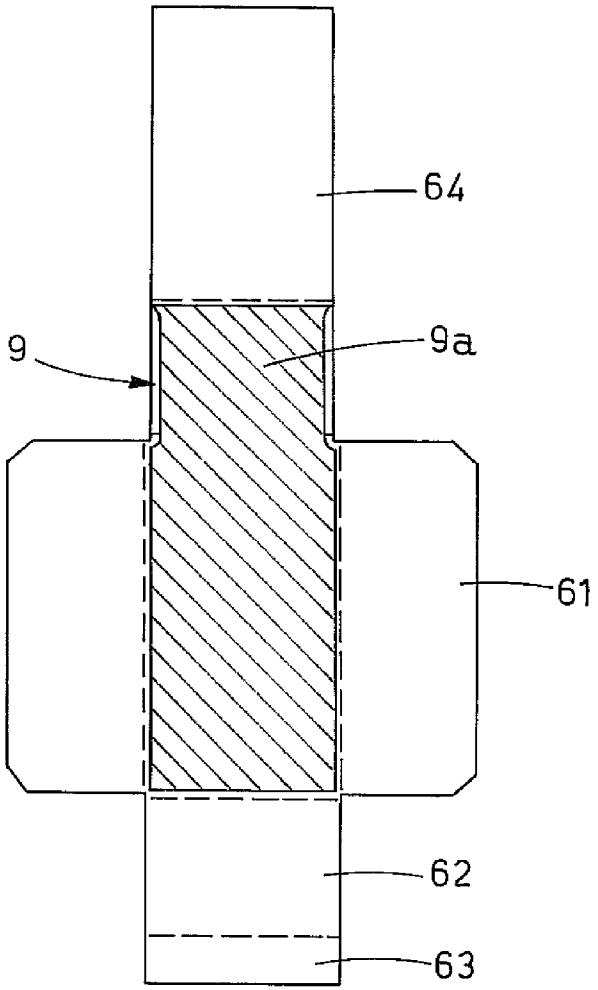
FIG. 7B illustrates a plan view of the ribbed cardboard in the same work stage of FIGS. 6 and 7A, highlighting the impression of a forming punch used in the apparatus.
Figure 7A:
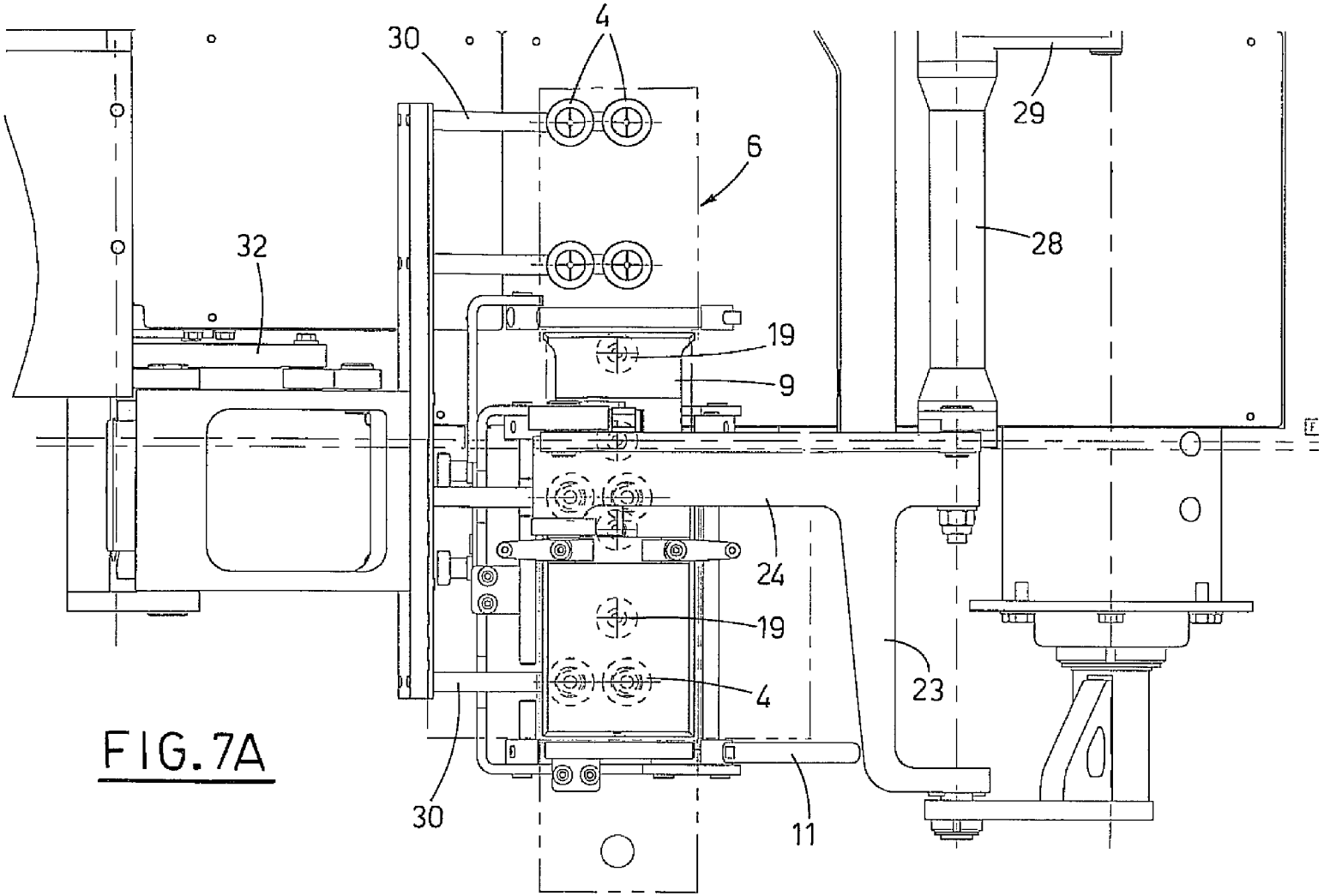
FIG. 7A illustrates a plan view of the apparatus in the work stage illustrated in FIG. 6.

A folding matrix 7 is arranged in the folding station F, which receives the ribbed cardboard sheet 6 in supply from the collecting device 2, in order to fold the sheet 6 according to the score lines 65. To this end the folding matrix 7 is provided with a plurality of fixed folding organs 8 destined during the folding stage to intercept the longitudinal flaps 61, a front transversal flap 62 and the rear flap 64 of the sheet 6. The folding organs 8 are destined to cooperate with a mobile forming punch 9 in order to fold the sheet 6 received from the collecting device 2. The forming punch 9 is essentially constituted by a body inferiorly exhibiting a flat work surface 9*a*, which is essentially rectangular. Note that the work surface 9*a* of the forming punch 9 corresponds substantially to the bottom surface 60 and a transversal flap 62 of the flat sheet 6 (see FIG. 7B). As specified herein below, the surface 9*a* is destined to be maintained in a horizontal position and to perform the folding by pressing the ribbed sheet 6, which is interposed between the surface 9*a* and the folding organs 8 of the folding matrix 7. Gripping means 19 are located at the work surface 9*a* of the forming punch 9, for example operating by aspiration and being suitably distanced (see FIG. 7A).

The forming punch 9 is oscillatingly borne by a transfer device 10 which moves the forming punch 9 between the folding station F and a release station R of the ribbed cardboard sheet 6 to a packing line 12 of the products. The packing line 12 is constituted, in a substantially known way, by a belt transport means 13 provided with appendages 14 which are perpendicular to the transport plane, which appendages 14 are regularly distanced and conform a series of tray compartments 15 which each can contain a single erected ribbed cardboard sheet 6.

Also associated to the folding matrix 7 are fixed contact means 11 which maintain the folded transversal flap 62 of the ribbed cardboard sheet 6 in a vertical position during the transport stage.

The transport device 10 comprises a first kinematism 21 for the main movement and a second kinematism 22 destined to function as a trim corrector to maintain the forming punch 9 in a horizontal position. The first kinematism 21 of main movement includes a pair of oscillating arms 20 which are parallel and pivoted to the base of a fixed rotation axis C. A bracket 23 is rotatably borne between the arms 20 at a further rotation axis D which is parallel to the fixed axis C, from which bracket 23 a transversal arm 24 projects which has, pivoted at a free end thereof, a support 16 of the forming punch 9. Also projecting from the bracket 23 is an activating lever 25 hinged to a command tie rod 26.

The bracket 23 posteriorly exhibits a pair of tabs 27 between which a shaft 28 is borne, according to rotation axis D, which shaft 28 is a component part of the trim-correcting second kinematism 22. The shaft 28 exhibits a transversal lug 18 to which an end of a tie rod 17 is hinged, which tie rod 17 is hinged at the other end thereof to the support 16 of the forming punch 9.

A lever 29, hinged to an upper end of a further tie rod 34 pivoted to the base on the fixed frame 40 of the apparatus, extends radially from the shaft 28.

Finally, tabs 36 are fixed to the support 16 of the forming punch 9, which maintain the folded longitudinal flaps 61 of the ribbed cardboard sheet vertical during the transfer stage.

The functioning of the apparatus for erecting the ribbed cardboard sheet 6 of the invention will now be described.

Figure 3:
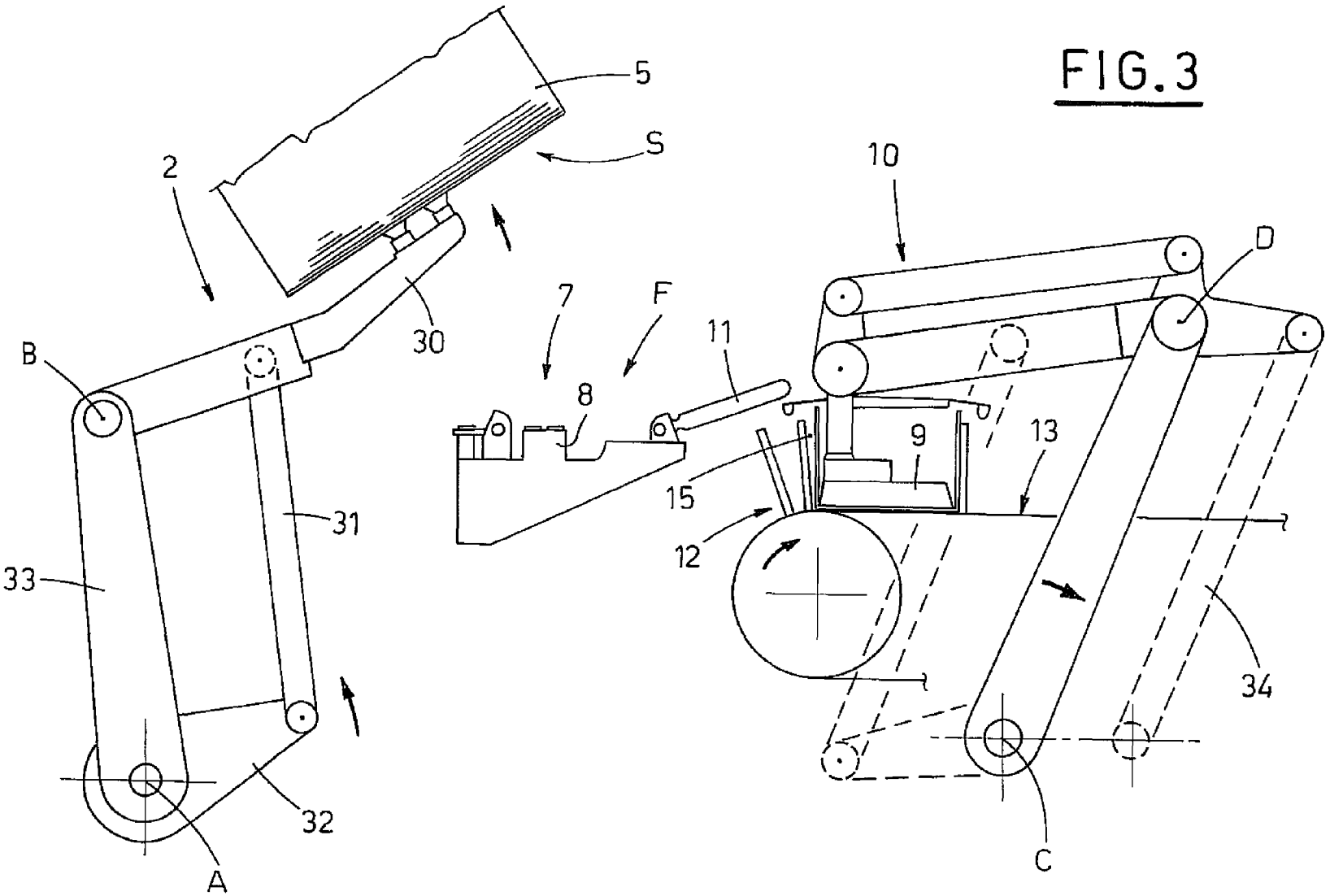
FIG. 3 is a lateral view of the apparatus, during the working stage of collecting a sheet of ribbed cardboard in order to erect it.
Figure 4:
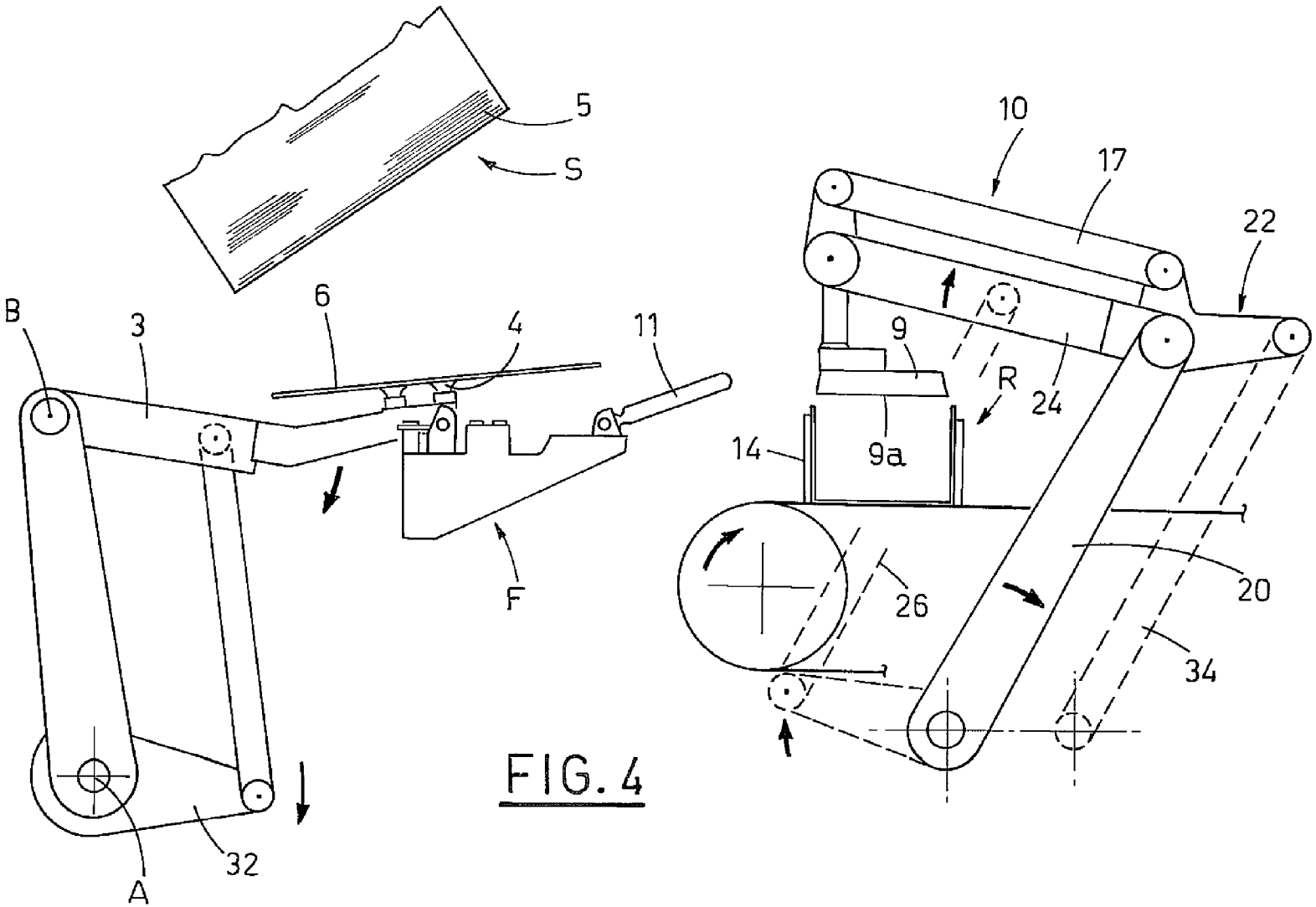
FIGS. 4, 5, 6, 8, 9 and 10 illustrate the lateral view of the apparatus during successive work stages.

In a first work stage, the collecting device 2 is activated to move in the direction of the collecting station S in order to bring the gripping organs 4 into contact with the lowest sheet 6 in the stack contained in the store 5 (FIG. 3). The activation of the gripping organs 4 and the following oppositely-directed activation of the collecting device 2 leads to removal of the sheet 6 from the store (FIG. 4). Observe that in this stage only the angular rotation of the frame 3 bearing the gripping organs 4 is activated via the corresponding angular rotation of the command lever 32.

Figure 5:
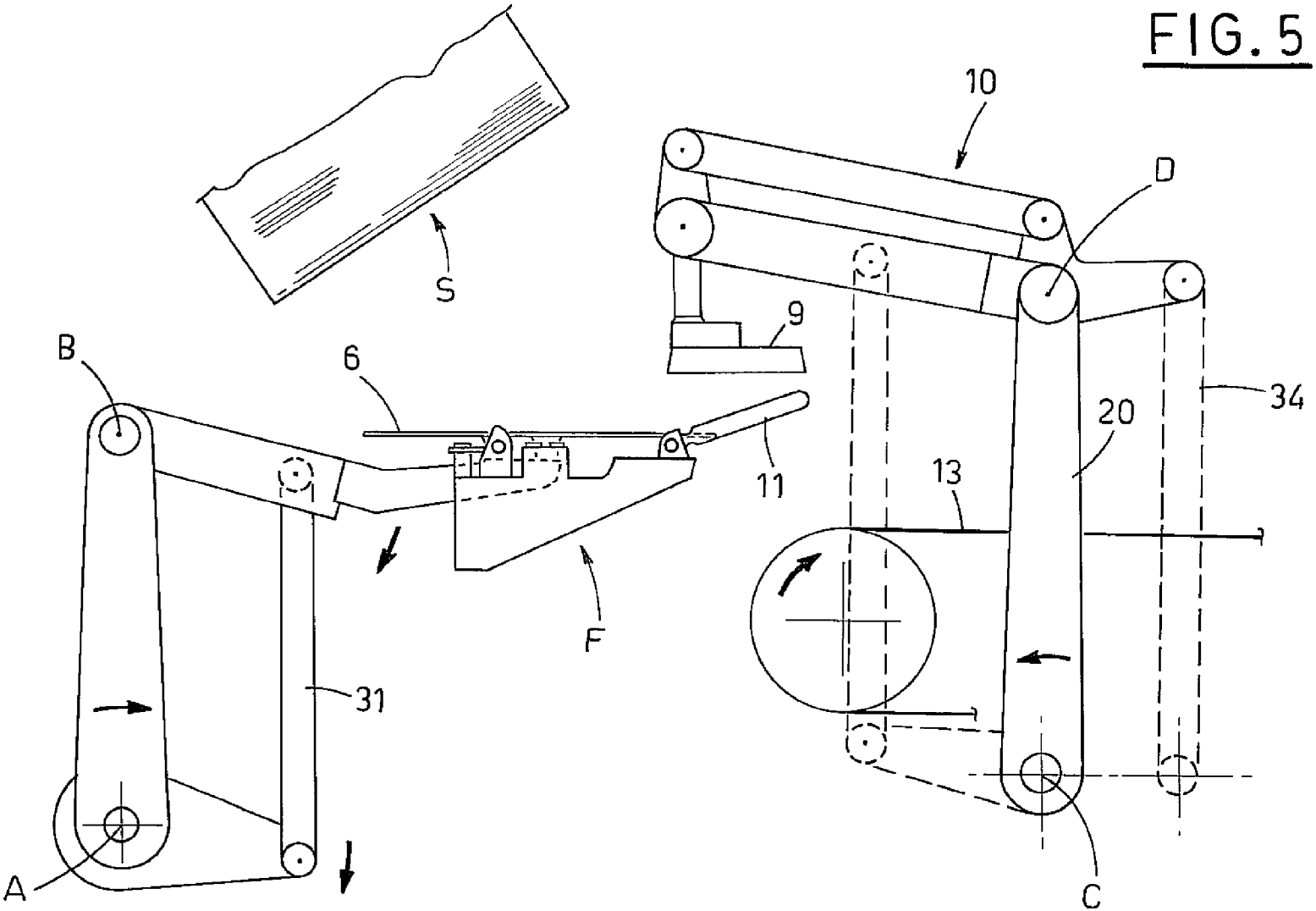

Thereafter, the angular rotation of the parallel arms 33 is simultaneously activated, which at the top thereof hingedly bear the frame (FIG. 5). This determines a rotating-translating movement of the frame 3 such as to maintain the ribbed cardboard sheet 6 borne by the gripping organs 4 substantially horizontal during the stage of entry onto the folding matrix 7 arranged in the folding station S. Note that the arms 30 of the frame 3 bearing the gripping organs 4 insert between the folding organs 84 of the folding matrix 7 in such a way as to deposit the sheet 6 to be folded onto the folding organs 8.

Figure 6:
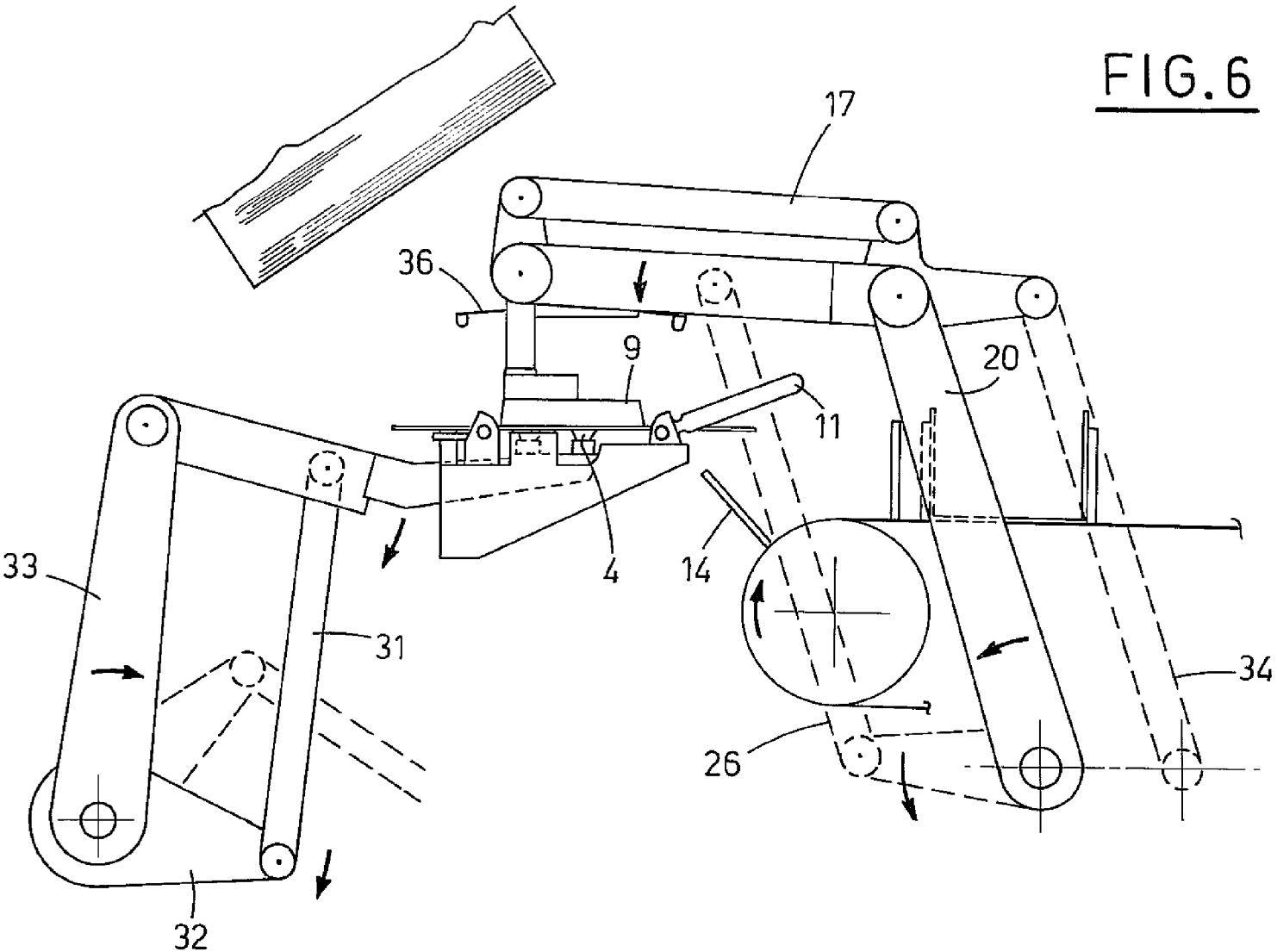

In suitable phase relation, the forming punch 9 is activated, which, staying in a horizontal position, nears the folding station S. When the ribbed sheet 6 is predisposed in an extended position on the folding matrix 7, the forming punch 9 is brought to the upper surface of the ribbed sheet 6 (FIG. 6). The ribbed sheet 6 is thus interposed between the surface 9*a* of the forming punch 9 and the folding means 8 of the folding matrix 7 (see FIGS. 7A and 7B).

Figure 8:
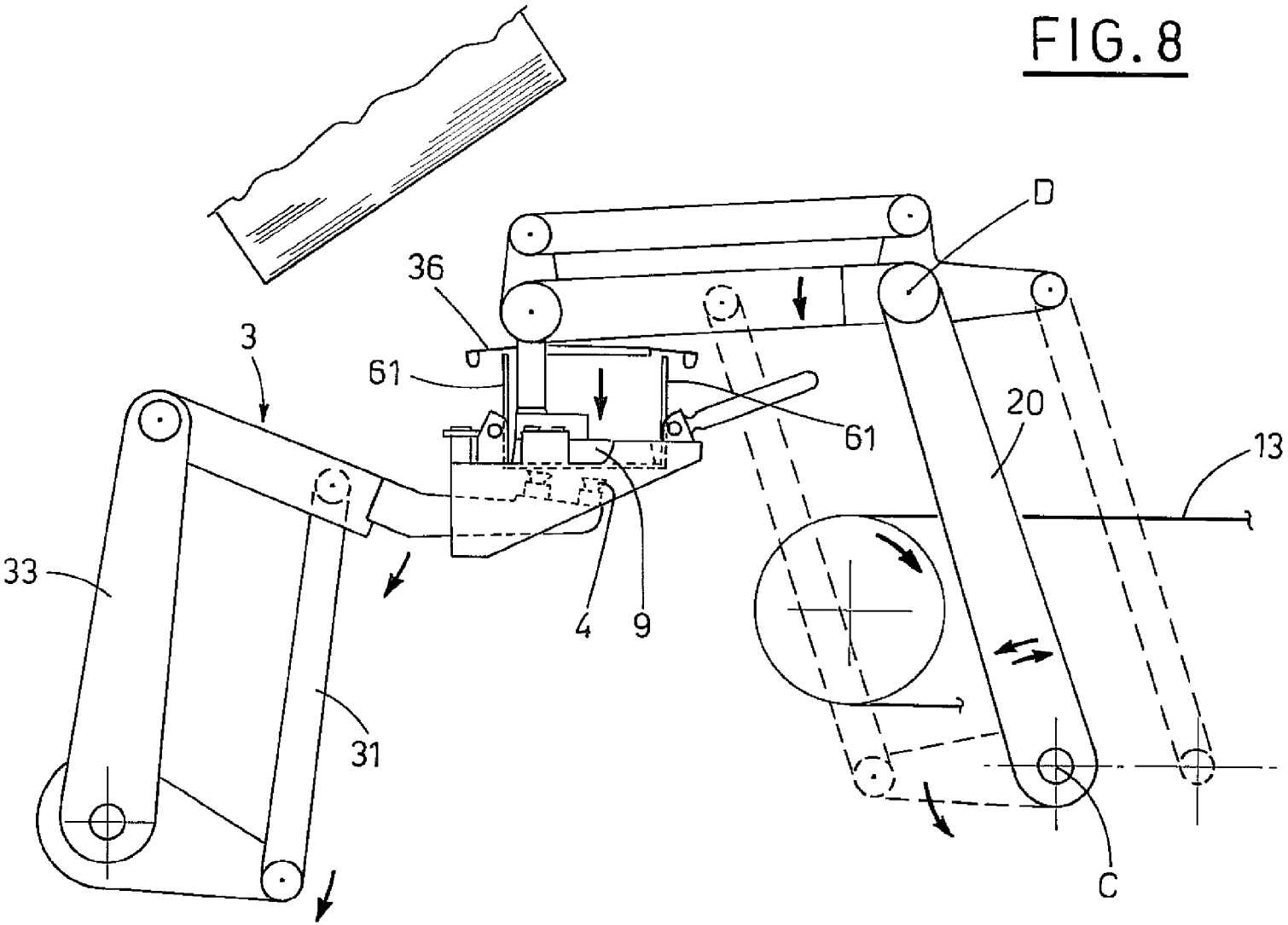

The ribbed sheet 6 is at the same time gripped by the gripping organs 19 of the forming punch 9 and by the gripping organs 4 of the collecting device 2, which move vertically in a downwards direction (FIG. 8).

The ribbed sheet 6 is forced against the folding organs 8 of the matrix 7, consequently operating the folding of the sheet 6 according to the predefined score lines 65. Note however that the profile of the work surface 9*a* of the forming punch 9 can precisely fold the sheet 6 even should the score lines not be present.

During the folding stage, the flaps 61, 62, 64 of the sheet 6 which are lateral with respect to the shape of the forming punch are brought into a substantially vertical position, following the fold lines impressed by the edges of the work surface 9*a* of the forming punch (see FIG. 8A for further illustration).

Figure 9:
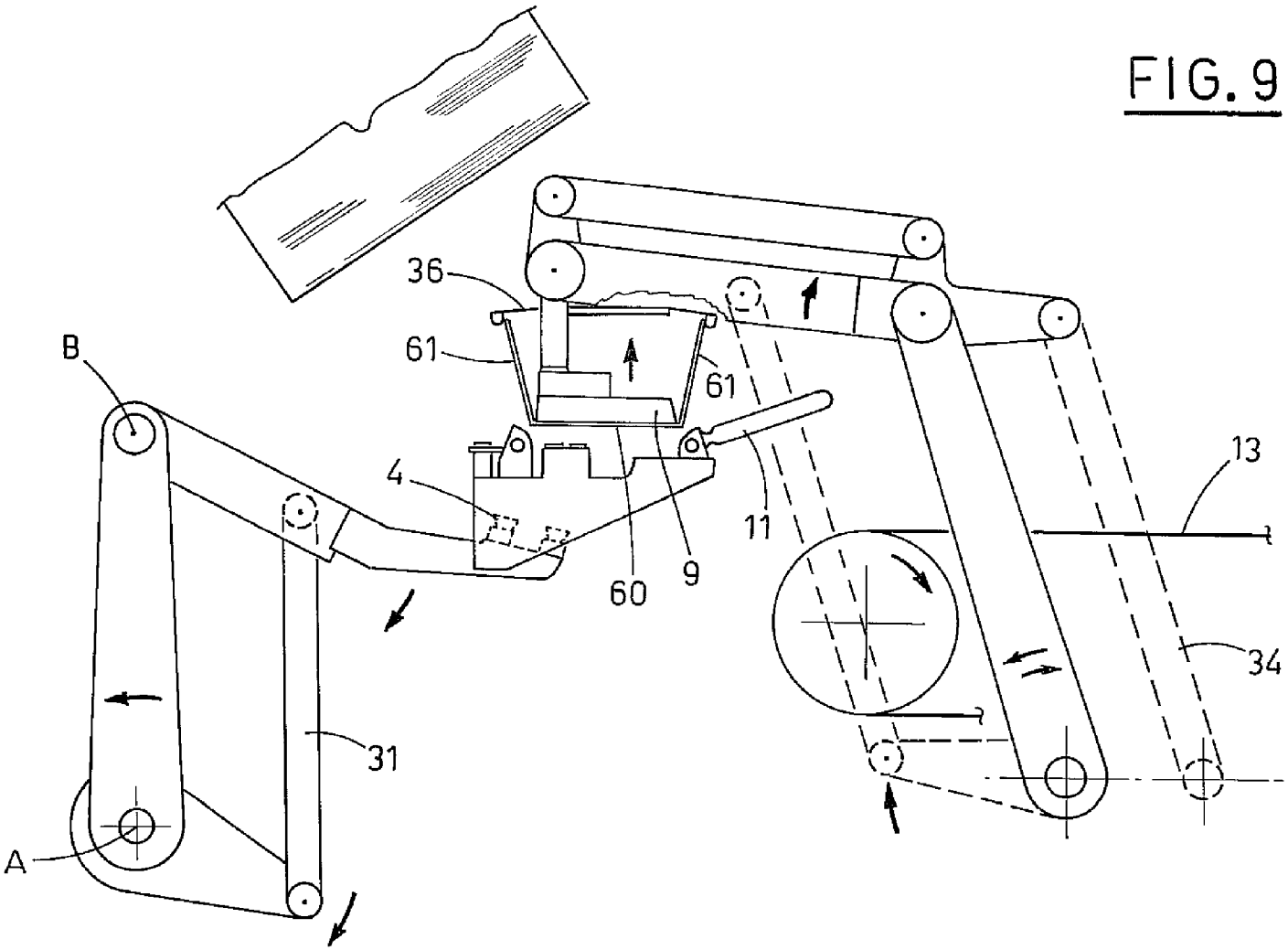

In phase relation with the above, the sheet 6 is released by the gripping organs 4 of the collecting device 2 which proceeds in its rotating-translating movement in order to predispose a new stage of collection, and the return run of the transfer device 10 is activated in order to bring the folded sheet 6 into the release station R in which the ribbed sheet 6 is inserted into the packing line 12 of the products (FIG. 9). Note that during this stage the folded flaps of the sheet 6, no longer engaged by the folding organs 8 of the folding matrix 7, are subject to elastic recall forces which tend to return it into a flatter configuration. To obviate this drawback, tabs 36 are included above the forming punch 9 which tabs 36 exert a lateral contact action on the folded longitudinal flaps 61 of the sheet 61, keeping them in an only-slightly oblique position (FIG. 9A). The frontally-arranged transversal flap 62, on the other hand, during the transfer engages frontally with the fixed contact means 11.

Figure 10:
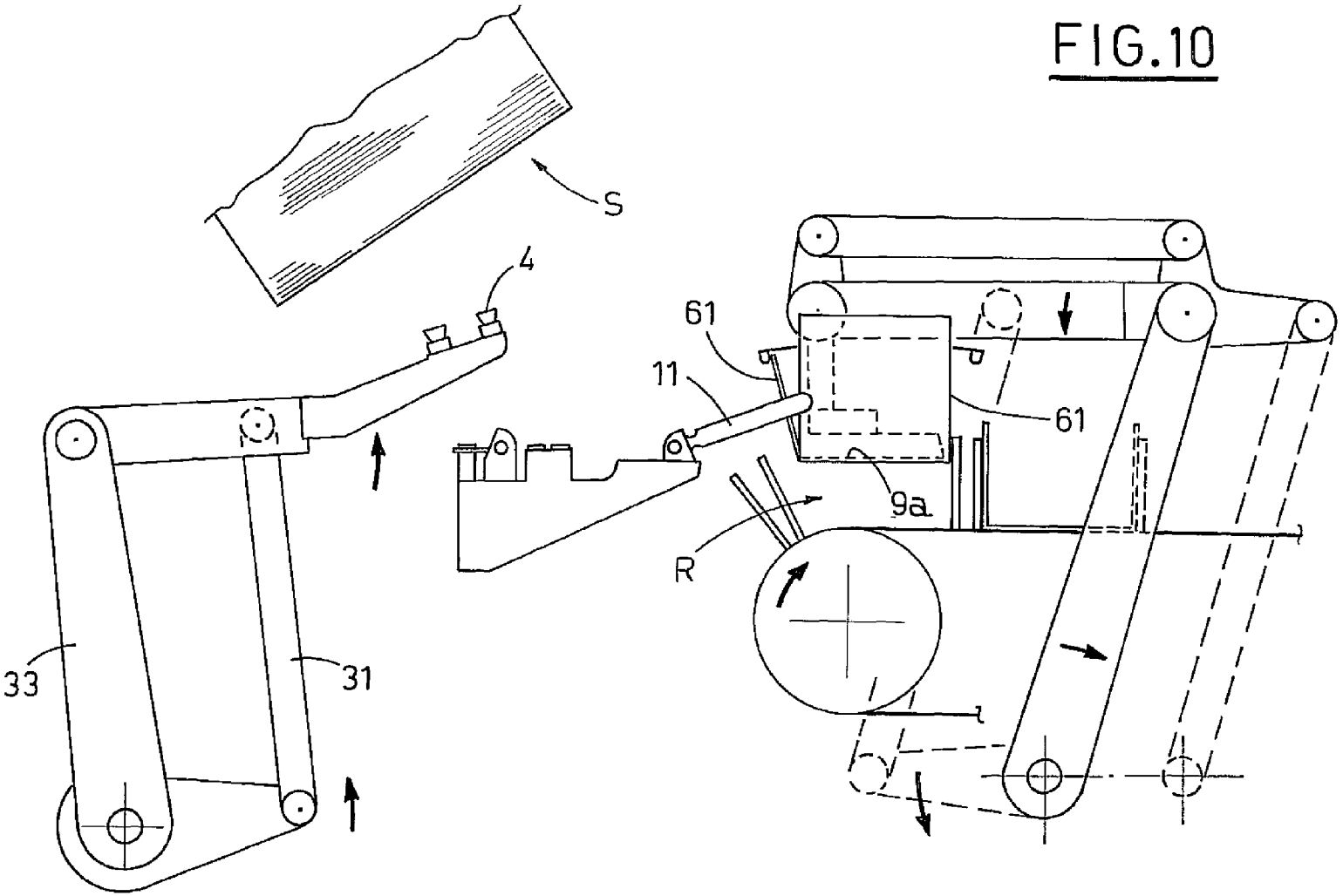

The forming punch 9 bearing the folded sheet 6 is translated and lowered into the release station R in such a way as to introduce the ribbed sheet 6 in a respective tray compartment 15 of the packing line 12 (see FIG. 10). The ribbed sheet 6 engages, during the stage of insertion into the tray compartment 15, with the appendages 14 of the belt transport means 13, which return the longitudinal flaps 61 into the configuration of being perpendicular to the bottom 60, still engaged by the forming punch 9 (see FIG. 3 once more). On completion of the insertion of the sheet 6 into the respective tray compartment 15, the detachment of the forming punch 9 is performed, the punch 9 then rising in order to be readied for a new forming stage (FIG. 4).

The apparatus of the present invention thus achieves the set aim of efficiently predisposing, erecting and inserting the ribbed sheet for protecting the products into the packing line.

An advantage of the apparatus is that it operates in a continuous cycle and at a high production rate. This is essentially determined by the fact that the forming punch which folds the sheet 6 in the folding matrix 7 is also capable of transferring the folded sheet to the packing line. Further, during the transfer stage of the folded sheet, a new sheet 6 is arranged on the folding matrix by the collecting device, with a further increase in working speed due to the reduction of dead times.

Note also that the apparatus of the invention enables efficient use to be made of both blank sheets of ribbed cardboard which exhibit special score line, and those which do not exhibit the score lines or which might otherwise have imperfect score lines.

A further advantage of the apparatus of the invention is that the set aims are achieved with a solution exhibiting great constructional and functional simplicity, as well as being provided with great versatility in relation to the various conformations of the articles to be packed.

The above is provided by way of non-limiting example, and any constructional variations are intended to fall within the ambit of protection of the present technical solution, as described herein above and as claimed herein below.

What is claimed:

1. An apparatus for erecting a blank sheet of ribbed cardboard and for inserting the erected blank sheet into a tray compartment of a packing line for protecting products packed therein, which comprises:

a collecting device having gripping means, the collecting device being movable between a gripping station and a folding station, the collecting device gripping a single flat blank sheet located in a store at the gripping station and moving the flat blank sheet to the folding station;

a folding matrix, arranged in the folding station, the folding matrix having a plurality of fixed folding means, the folding matrix receiving the flat blank sheet of ribbed cardboard supplied by the collecting device;

a forming punch having a body interiorly exhibiting a flat work surface and having gripping means located at the flat work surface, for gripping an upper surface of the blank sheet;

a transfer device hingedly bearing the forming punch, the transfer device moving the forming punch with the flat work surface to a position above the upper surface of the flat blank sheet of ribbed cardboard located on the folding matrix and then moving the forming punch downwardly to force the blank sheet against the fixed folding means of the folding matrix for folding opposite lateral flaps of the blank sheet into a folded configuration by contact with the folding means, the gripping means of the forming punch gripping the upper surface of the folded blank sheet for retaining the blank sheet in the folded configuration, the upper surface forming at least an interior bottom surface of the erected blank sheet, the transfer device moving the folded blank sheet to a releasing station and placing the retained folded sheet into the tray compartment of the packing line, the gripping means of the folding punch then releasing the folded blank sheet in the tray compartment.

2. The apparatus of claim 1, wherein the collecting device gripping means are borne by a frame which is movable with a rotating-translating movement between the gripping station and the folding station.

3. The apparatus of claim 2, wherein the frame is hingedly mounted to a connecting tie rod which connects to a command lever which is angularly rotatable about a first axis, at least one arm provided which is pivotable about the first axis independently of the command lever, the at least one arm bearing the frame by having an end hinged to a top thereof, the end of the at least one arm being pivotable about a second axis parallel to the first axis.

4. The apparatus of claim 2, wherein the frame has a plurality of parallel arms provided at ends thereof with the parallel arms including gripping means, the parallel arms being spaced apart for insertion between the folding means and the folding matrix.

5. The apparatus of claim 1, wherein the flat work surface of the forming punch has an essentially rectangular shape substantially corresponding to the interior bottom surface and an interior transversal flap surface of the erected blank sheet.

6. The apparatus of claim 5, wherein the gripping means located at the work surface of the forming punch are spaced apart for retaining the sheet after folding.

7. The apparatus of claim 1, wherein the folding matrix includes fixed abutment means for maintaining a folded transversal flap of the sheet substantially vertical during transfer of the folded blank sheet to the packing line.

8. An apparatus for erecting a blank sheet of ribbed cardboard and for inserting the erected blank sheet into a tray compartment of a packing line for protecting products packed therein, which comprises:

a collecting device having gripping means, the collecting device being movable between a gripping station and a folding station, the collecting device gripping a single flat blank sheet located in a store at the gripping station and moving the flat blank sheet to the folding station;

a folding matrix, arranged in the folding station, the folding matrix having a plurality of fixed folding means, the folding matrix receiving the flat blank sheet of ribbed cardboard supplied by the collecting device;

a forming punch having a support and a body interiorly exhibiting a flat work surface and having gripping means located at the flat work surface, for gripping an upper surface of the blank sheet, the forming punch having tabs fixed to the support;

a transfer device hingedly bearing the support of the forming punch, the transfer device moving the forming punch with the flat work surface to a position above the upper surface of the flat blank sheet of ribbed cardboard located on the folding matrix and then moving the forming punch downwardly to force the blank sheet against the fixed folding means of the folding matrix for folding opposite lateral flaps of the blank sheet into a folded configuration by contact with the folding means, folded flaps being engaged by the tabs of the folding punch, the gripping means and the tabs of the forming punch gripping the folded blank sheet for retaining the blank sheet in the folded configuration, the upper surface forming at least an interior bottom surface of the erected blank sheet, the transfer device moving the folded blank sheet to a releasing station, placing the retained folded sheet into the tray compartment of the packing line, the gripping means of the folding punch then releasing the folded blank sheet in the tray compartment.

* * * * *